US011953277B1

(12) United States Patent
Tseng

(10) Patent No.: US 11,953,277 B1
(45) Date of Patent: Apr. 9, 2024

(54) FIRING CONTROL SYSTEM WITH MULTIPLE SAFETIES

(71) Applicant: FORMOSAN ARSENAL GROUP CO., LTD., Taoyuan (TW)

(72) Inventor: Shu Hui Tseng, Taoyuan (TW)

(73) Assignee: FORMOSAN ARSENAL GROUP CO., LTD., Taoyuan (TW)

( * ) Notice: Subject to any disclaimer, the term of this patent is extended or adjusted under 35 U.S.C. 154(b) by 0 days.

(21) Appl. No.: 18/116,778

(22) Filed: Mar. 2, 2023

(30) Foreign Application Priority Data

Jan. 13, 2023 (TW) ..... 112101606

(51) Int. Cl.
*F41A 17/32* (2006.01)
*F41A 17/66* (2006.01)
*F41A 17/72* (2006.01)

(52) U.S. Cl.
CPC ..... *F41A 17/32* (2013.01); *F41A 17/66* (2013.01); *F41A 17/72* (2013.01)

(58) Field of Classification Search
CPC ..... F41A 17/72; F41A 17/46; F41A 17/48; F41A 17/56; F41A 17/58; F41A 17/64; F41A 17/66; F41A 17/32
USPC ..... 42/7, 70.08, 70.06, 70.01
See application file for complete search history.

(56) References Cited

U.S. PATENT DOCUMENTS

2006/0191182 A1* 8/2006 Curry ..... F41A 17/02 42/70.04
2011/0289811 A1* 12/2011 Gentilini ..... F41A 19/35 42/69.02
2013/0133237 A1* 5/2013 Domian ..... F41A 17/36 42/70.02
2015/0292828 A1* 10/2015 Nebeker ..... F41A 17/46 42/69.01
2017/0184366 A1* 6/2017 Zajk ..... F41A 19/15
2019/0041151 A1* 2/2019 Folk ..... F41A 19/10
2020/0278167 A1* 9/2020 Hughes ..... F41C 23/10
2021/0080211 A1* 3/2021 Barrett ..... F41A 17/46
2021/0222980 A1* 7/2021 O'Clair ..... F41A 19/12
2022/0252366 A1* 8/2022 Vaughan ..... F41A 17/42

* cited by examiner

*Primary Examiner* — John Cooper
(74) *Attorney, Agent, or Firm* — Che-Yang Chen; Law Office of Michael Chen

(57) ABSTRACT

A firing control system with multiple safeties is disclosed. It comprises a base, a return spring, a firing pin releaser, and a trigger connecting bar. The trigger connecting bar is connected with the trigger of the pistol and has a firing safety portion with a T shape. The design of the firing safety portion with a limit protrusion portion of the firing pin releaser of the present invention form a safety mechanism for unintentional discharge of the pistol, which improves the problem that the existing improved products are easy to cause the pistol to fire under an unfired state.

12 Claims, 14 Drawing Sheets

FIRING CONTROL SYSTEM WITH MULTIPLE SAFETIES

FIELD OF THE INVENTION

The present invention relates to a pistol accessory. More particularly, the present invention relates to a firing control system with multiple safeties which is installed inside a pistol.

BACKGROUND OF THE INVENTION

Pistol is an ancient weapon. It was first seen in the sixteenth century AD. In the United States, the pistol is the most common self-defense weapon and is also used in some competitive games. For freedom and safety, most households have at least one pistol in case of emergency.

With hundreds of years of technical improvement, today's pistol has the following advantages: high accuracy, fast reloading speed, strong lethality and easy maintenance. Ordinary people can easily get started after simple use training. However, the loaded pistol is in a dangerous state. If it is not handled properly, such as the pistol falling to the ground or touching it by mistake, it is easy to cause misfire and trigger the bullet. Since the muzzle position of the current pistol is uncertain, the probability of accidentally injuring people around is very high. Therefore, most pistols have an anti-misfire design.

Take GLOCK 43 pistol (the 5th generation product including models 17 and 19 with similar actuators) as an example, it is a very popular product in Europe and America. It has three safeties for unintentional discharge. A first safety for unintentional discharge is trigger safety. It is installed in the trigger in the form of a lever. When the trigger is pulled alone, the trigger safety catches the socket seat to prevent the trigger from moving backwards. When firing the pistol, it is only to press the trigger safety first then pull the trigger. A second safety for unintentional discharge is firing pin safety. The firing pin safety is a short cylinder with a spring inside. When the GLOCK 43 is in the unfired state, the firing pin safety blocks the firing pin to prevent it from hitting the bullet primer. When the trigger is pulled back, the trigger bar pushes the firing pin safety up, and the firing pin passes through the firing pin safety to fire the bullet. The firing pin safety is then reset by the force of the spring, blocking the firing pin again. A third safety for unintentional discharge is falling safety. The falling safety is part of the trigger bar design, located on the safety ramp inside the trigger mechanism housing. The falling safety engages the rear of the firing pin to prevent the firing pin from moving forward. When the trigger is pulled back, the trigger bar lowers the falling safety position and releases the firing pin. After firing, the trigger bar moves up, and the falling safety re-engages the firing pin. In practice, the three safeties for unintentional discharge are all directly or indirectly connected to the trigger bar. Since the pistol will move the trigger bar when it is shaken, it may cause the safeties for unintentional discharge to fail. In addition, when the user shoots the gun, he has to overcome the resistance of the trigger bar pulling the firing pin, so the strength of the finger is strengthened, which is easy to cause shooting deviation.

In order to solve the abovementioned defects in the GLOCK 43 original design, some parts manufacturers have improved the original trigger bar. For example, an Alpha Competition Series for Glock Gen 5 product developed by TIMNEY TRIGGERS is an example. The improvement of the product for GLOCK 43 is to cancel the mechanism of pulling the firing pin by the falling safety but still remain a safety mechanism to block the firing pin ready to fire. At the same time, the stroke of the improved terminal safety design is perpendicular to the direction of travel of the firing pin. The work of pulling the firing pin is handed over to slide. Therefore, when shooting, the force of the user to pull the trigger is smaller than that of the original factory, which reduces the operation resistance and increases the accuracy of aiming. The overall design of the product can perfectly replace the original trigger bar without modifying the pistol. However, many users who have used the GLOCK 43 pistol modified by the Alpha Competition Series for Glock Gen 5 have found that the product is prone to fire due to impact. The reason is that although the end safety is supported by the spring and can protrude to block the firing pin, but if the pistol is impacted, such as falling to the ground, the spring and the end safety will also vibrate accordingly, and the firing pin may go over the end safety and the pistol fires. An easy way to improve this is to increase the stiffness of the spring (make it stiffer). But in this way, it will become more difficult for the user to pull the trigger, and the hidden danger of misfire still exists.

In order to solve the defects of the above-mentioned improved products, let GLOCK 43 and its extended products have both excellent operability and safety, thus the present invention is proposed.

SUMMARY OF THE INVENTION

This paragraph extracts and compiles some features of the present invention; other features will be disclosed in the follow-up paragraphs. It is intended to cover various modifications and similar arrangements included within the spirit and scope of the appended claims.

In order to meet the aforementioned requirements, a firing control system with multiple safeties is disclosed. The firing control system with multiple safeties is used to replace a trigger bar and a trigger spring in a pistol consisting of model GLOCK 17, GLOCK 19 and GLOCK 43 and comprises: a base, installed inside a trigger mechanism housing of the pistol, having a front end and a rear end which is lower than the front end, wherein an arc surface groove is formed in the front end, and the rear end is concave to form a clamping platform; a return spring, an end thereof is placed on the clamping platform; a firing pin releaser, comprising: an arc surface turning portion, rotatably mounted in the arc surface groove; a limit protruding portion, formed on one side of the arc surface turning portion, stopping the arc surface turning portion from rotating toward a forward direction relative to the arc surface groove by contacting a first side plane of the front end; a body portion, extended from and formed on the other side of the arc surface turning portion, wherein a limit side plane and a clamping surface are formed on the bottom of the body portion, the body portion stops the arc surface turning portion from rotating toward a reverse direction relative to the arc surface groove by contacting a second side plane between the front end and the rear end with the limit side plane, and the return spring is clamped by the clamping surface and the clamping platform clamp; and a release portion, protrudingly formed on the top of an end of the body portion, for holding or releasing firing pin handle of a firing pin of the pistol; and a trigger connecting bar, having a connecting portion movably linking to a trigger of the pistol, a linkage portion bent to bypass a magazine of the pistol and connected to the connecting portion, a guiding portion connected to an end of the linkage portion, and a trigger safety portion extended vertically from the guiding portion and movably located above the firing pin releaser, wherein the guiding portion is placed in a connector of the pistol, and when the firing pin of the pistol is ready to fire, the trigger safety portion suppresses the limit protruding portion upon the first side plane, so that the release portion is moved up by rotation of the arc surface turning portion to hold the firing pin handle.

According to the present invention, after the trigger under a status ready to fire is pulled, the trigger connecting bar is linked to move, the guiding portion is pushed by the connector to move down toward a direction below the pistol, driving the trigger safety portion to move toward the direction below the pistol and the direction of the release portion, so that the firing pin releaser rotates relative to the base by the arc surface turning portion rotating relative to the arc surface groove until the limit side plane contacts the second side plane, and the position of the release portion is lowered to release the firing pin handle.

According to the present invention, a guiding plane is formed on the top of the body portion.

According to the present invention, the trigger safety portion the trigger safety portion may further comprise: an extension board, extended vertically from the guiding portion, having a suppressing plane formed below; and a stopping moving board, facing the limit protruding portion and being formed in the middle of the extension board, wherein an angle is formed between the stopping moving board and the extension board. When the firing pin is ready to fire, the end of the stopping moving board suppresses the limit protruding portion upon the first side plane. After the trigger under the status ready to fire is pulled, the suppressing plane of the extension board slides along the guiding plane and the body portion is pushed down to rotate the firing pin releaser relative to the base.

According to the present invention, the connector may comprise a sideways guide plate. The guiding portion forms an arc-shaped area facing the sideways guide plate. After the trigger under the status ready to fire is pulled and the trigger connecting bar is linked to move, the arc-shaped area touches the sideways guide plate and is pushed by the sideways guide plate to move toward the direction below the pistol.

According to the present invention, a firing pin safety switch may be further formed on and protruded from the top of the linkage portion. The top of the firing pin safety switch meets a firing pin safety of the pistol. After the trigger under the status ready to fire is pulled and the trigger connecting bar is linked to move, the firing pin safety switch moves up slightly to turn on the firing pin safety and returns to original position by the elasticity of the firing pin safety switch after shooting.

Preferably, a rotatable angle that the arc surface turning portion is able to rotate relative to the arc surface groove ranges from 6 degrees to 10 degrees.

According to the present invention, the base and the firing pin releaser have substantially parallel two main planes, respectively. When the main planes of the base and the main plane of the firing pin releaser fall on a plane on one side, the other main planes of the base and the firing pin releaser fall on another plane on the other side.

According to the present invention, after the pistol fires, the firing pin handle sits above the trigger safety portion.

According to the present invention, when a slide of the pistol moves backwards, the firing pin is driven to move, causing the firing pin handle to move toward the rear of the release portion after pushing down the release portion. The release portion is pushed to move down to let the firing pin releaser rotate relative to the base by the arc surface turning portion rotating relative to the arc surface groove. The firing pin releaser is rotated back to original position by the return spring, so that the release portion holds the firing pin handle again.

Preferably, the base and the firing pin releaser is made of metal and formed by electrical discharge machining process.

Preferably, the trigger connecting bar is made from metal plate and shaped by stamping process.

The trigger safety portion of the present invention with the design of the limit protruding portion of the firing pin releaser forms a safety mechanism to prevent the pistol from unintentional discharge. It improves the problem that the existing improved products are easy to fire in a ready-to-fire state.

DETAILED DESCRIPTION OF THE PREFERRED EMBODIMENTS

The present invention will now be described more specifically with reference to the following embodiments.

Figure 1:
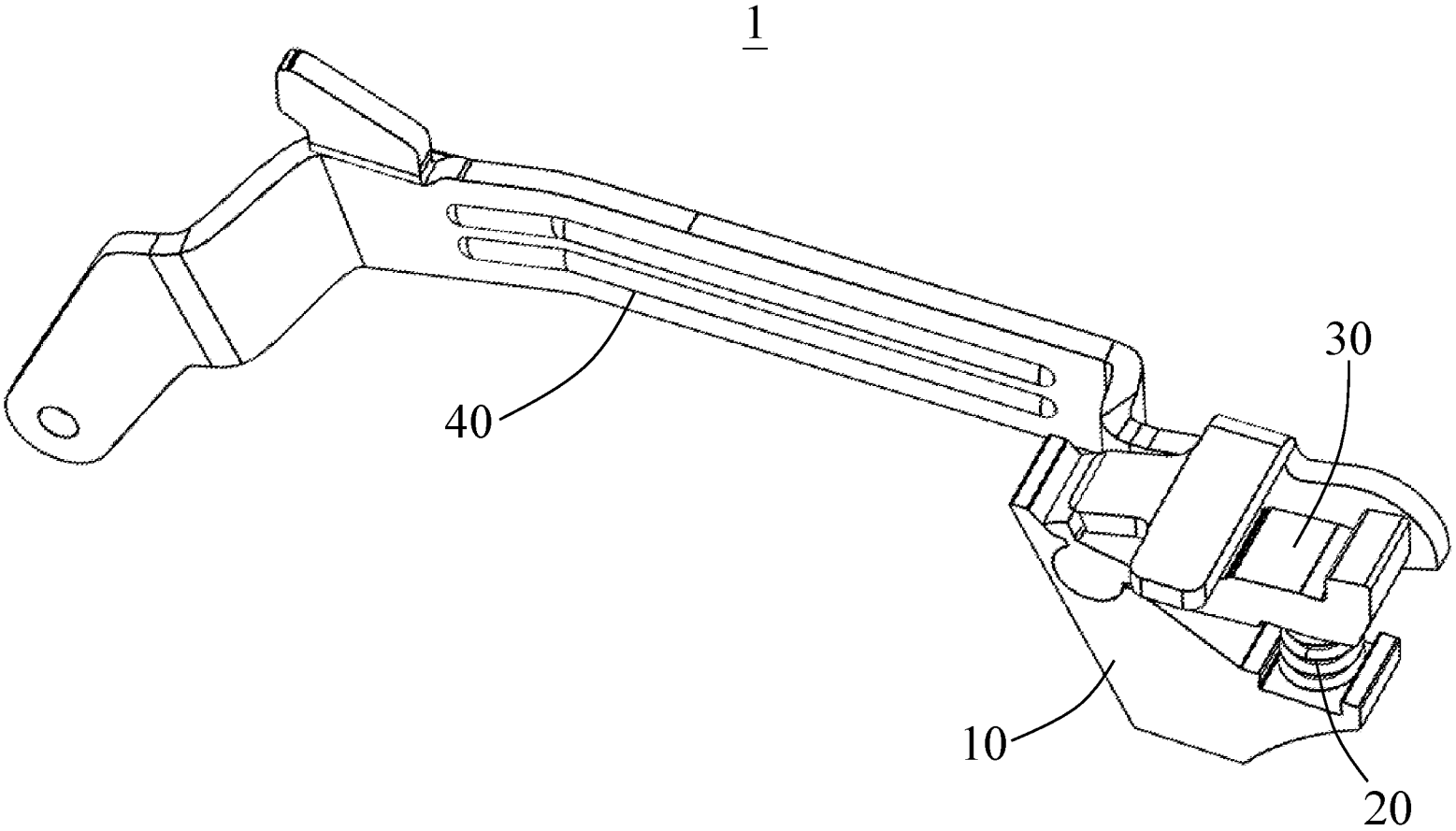
FIG. 1 is stereogram of a firing control system with multiple safeties according to an embodiment of the present invention.

See FIG. 1. It is stereogram of a firing control system with multiple safeties 1 according to an embodiment of the present invention. The function of the firing control system with multiple safeties 1 is to replace a trigger bar and a trigger spring of a pistol. The pistol includes model GLOCK 17, GLOCK 19 and GLOCK 43. GLOCK 17, GLOCK 19 and GLOCK 43 are several models of pistol produced and sold by the Austrian gun manufacturer, Glock. These models use the same trigger bar and trigger spring as the firing mechanism. Since the original design from the factory causes users to use a lot of effort to pull the trigger, which will cause shooting deviation, so it is necessary to improve the design of the trigger bar and trigger spring. The firing control system with multiple safety 1 of the present invention replaces the aforementioned components without affecting other original hardware of the pistols except the trigger bar and trigger spring and provides a safe safety design in the ready-to-fire state. The following example take GLOCK 43 (hereinafter referred to as pistol) as the installation environment as an example to illustrate.

Figure 3:
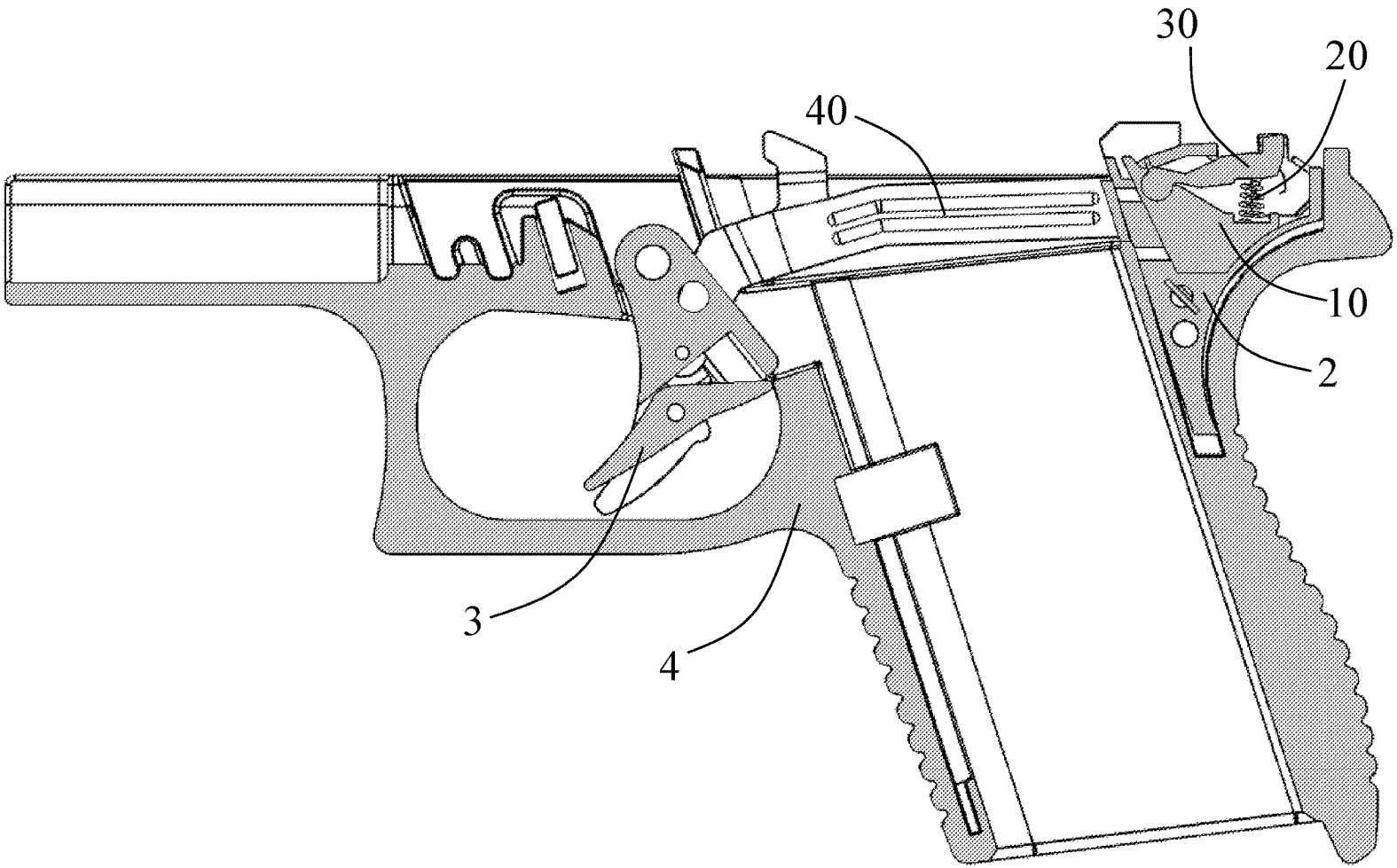
FIG. 3 is a sectional view of the firing control system with multiple safeties installed in an original frame of the GLOCK 43.
Figure 4:
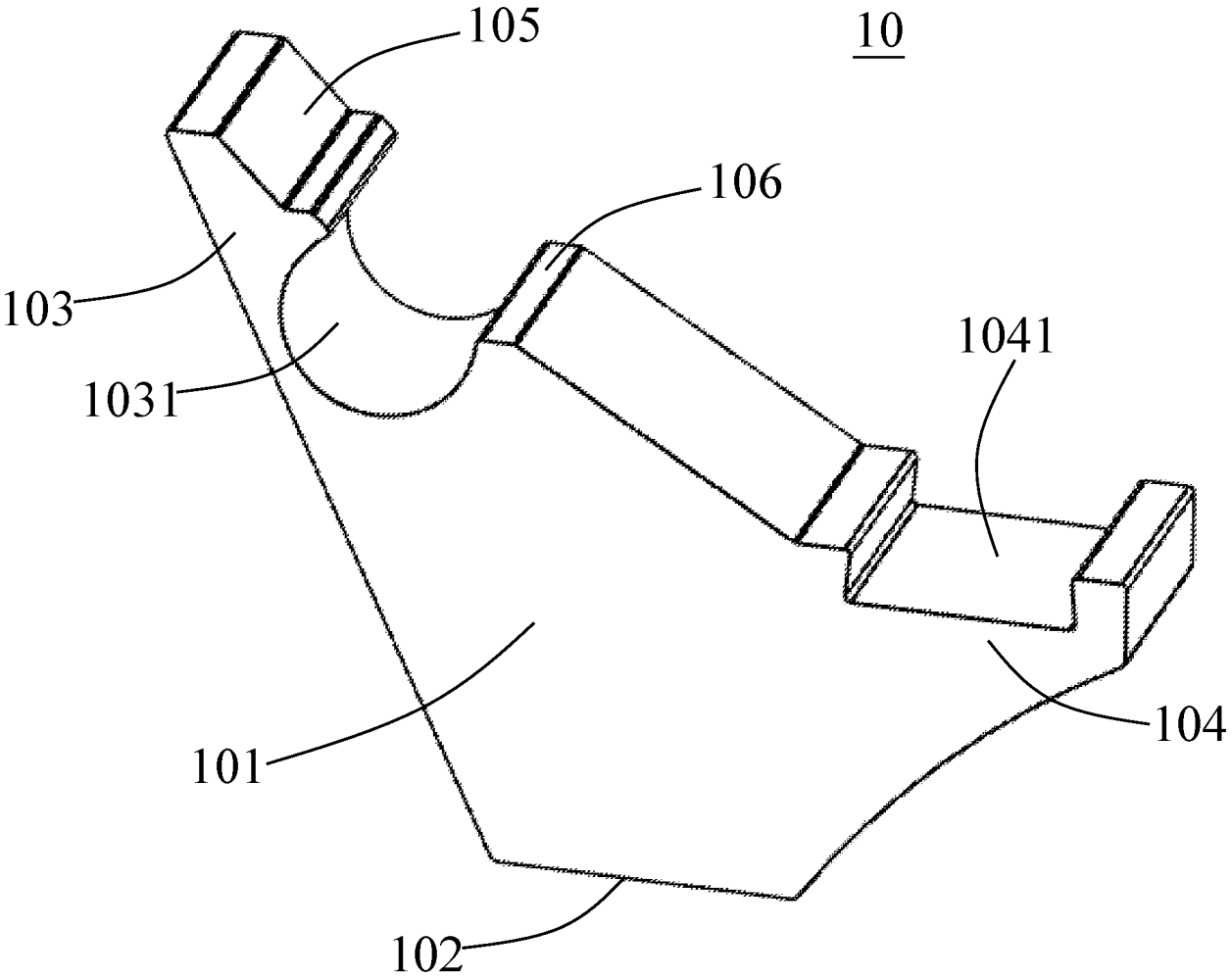
FIG. 4 is a stereogram of a base.
Figure 5:
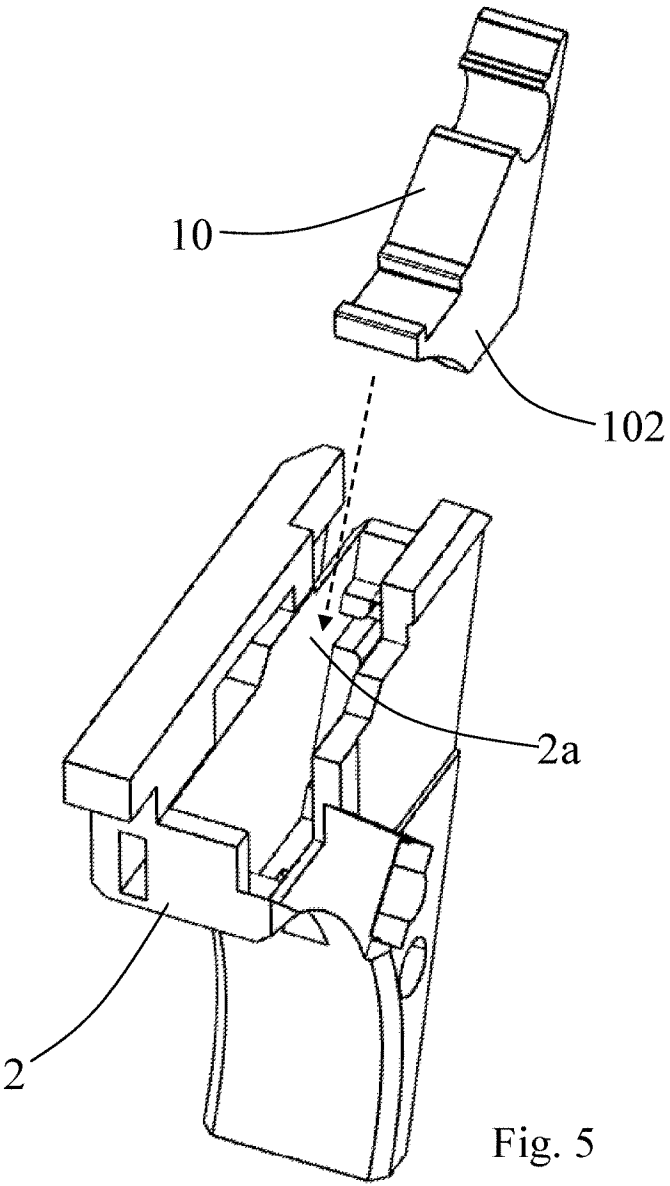
FIG. 5 shows the assembly of the base and the original trigger mechanism housing.

The firing control system with multiple safeties 1 includes a base 10, a return spring 20, a firing pin releaser 30 and a trigger connecting bar 40. See FIG. 3. It is a sectional view of the firing control system with multiple safeties 1 installed in an original frame of the GLOCK 43. During said components, the base 10, the return spring 20 and the firing pin releaser 30 are assembled to install inside a trigger mechanism housing 2 of the pistol. The trigger connecting bar 40 is installed in an original frame 4 of the pistol, contacting the firing pin releaser 30 at different locations under different states (ready-to-fire state and fired state). See FIG. 4 and FIG. 5. FIG. 4 is a stereogram of the base 10. FIG. 5 shows the assembly of the base 10 and an original trigger mechanism housing 2. The base 10 is installed inside the trigger mechanism housing 2 of the pistol. The installation method is shown by the dotted arrow in FIG. 5. The base 10 has substantially parallel two base main planes 101 (the other base main plane 101 in FIG. 4 is on the other side of the base 10). The width between two base main planes 101 is slightly smaller than the width of an accommodation space in the trigger mechanism housing 2. In addition, the base 10 has a front end 103 and a rear end 104. The rear end 104 is lower than the front end 103. An arc surface groove 1031 is formed in the front end 103. The rear end 104 is concave to form a clamping platform 1041. One end of the return spring 20 is placed on the clamping platform 1041. In terms of functional design, the base 10 forms a first side plane 105 and a second side plane 106, as shown in FIG. 4. The functions and positions of the first side plane 105 and the second side plane 106 will be explained below together with other components. As shown in FIG. 5, arrange the bottom 102 of the base 10 towards the opening 2*a* of the trigger mechanism housing 2, and then put it directly into the trigger mechanism housing 2 (follow the direction of the dotted arrow). It is easy to assemble and replace. The base 10 can be fixed in the trigger mechanism housing 2 without other auxiliary design, such as screw hole. In practice, base 10 is made of metal, such as high-strength carbon steel or alloy steel, formed by electrical discharge machining process.

Figure 6:
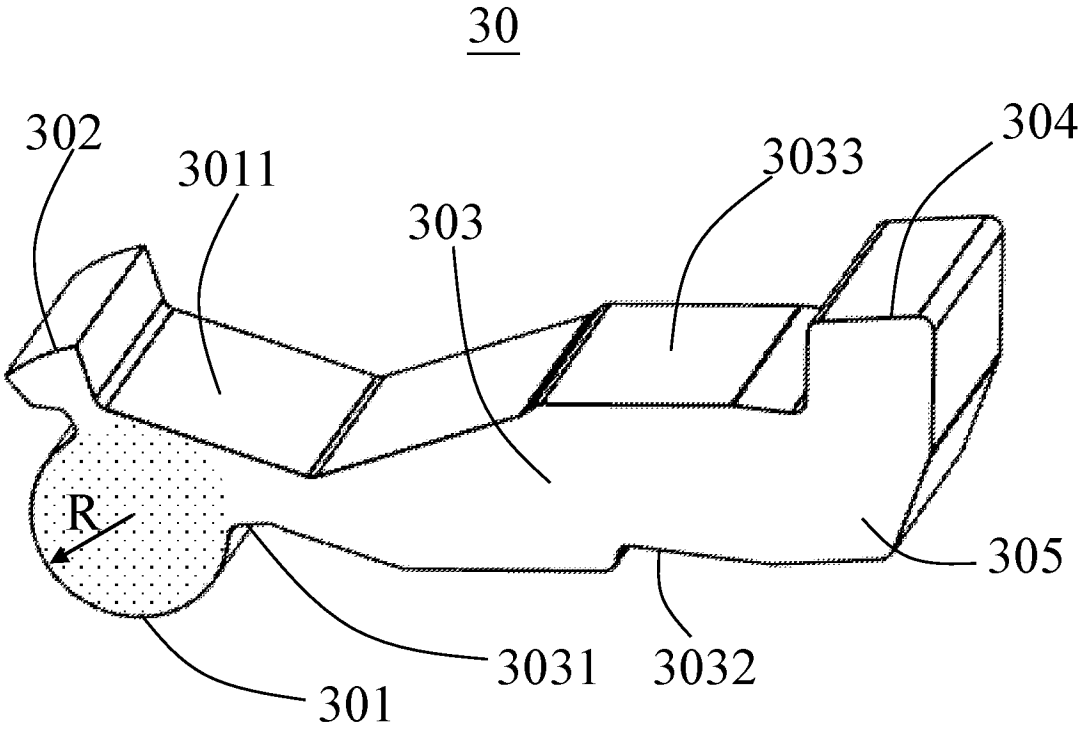
FIG. 6 is a stereogram of a firing pin releaser.

See FIG. 6. It is a stereogram of the firing pin releaser 30. The firing pin releaser 30 is a one-piece structure, composed of an arc surface turning portion 301, a limit protruding portion 302, a body portion 303 and a release portion 304. Looking at the firing pin releaser 30 from above, its surrounding shape resembles a penguin. The arc surface turning portion 301 is like a penguin's head, the limit protruding portion 302 is like a penguin's beak, the body portion 303 is like a penguin's body, and the release portion 304 is like a penguin's feet. The base of arc surface turning portion 301 is a short cylinder (marked with dotted bottom in FIG. 6). Parallel to the extension direction of the short cylinders forms a side platform 3011. The short cylinders have a radius R. A circular arc is formed with the radius R. The part of the arc surface ends at both ends of side platform 3011. The inner plane of arc surface groove 1031 of base 10 is also an arc surface, having a radius equal to or slightly larger than the radius R. Therefore, the arc surface turning portion 301 can be inserted into the arc surface groove 1031 and is rotatably mounted in the arc surface groove 1031.

Figure 7A:
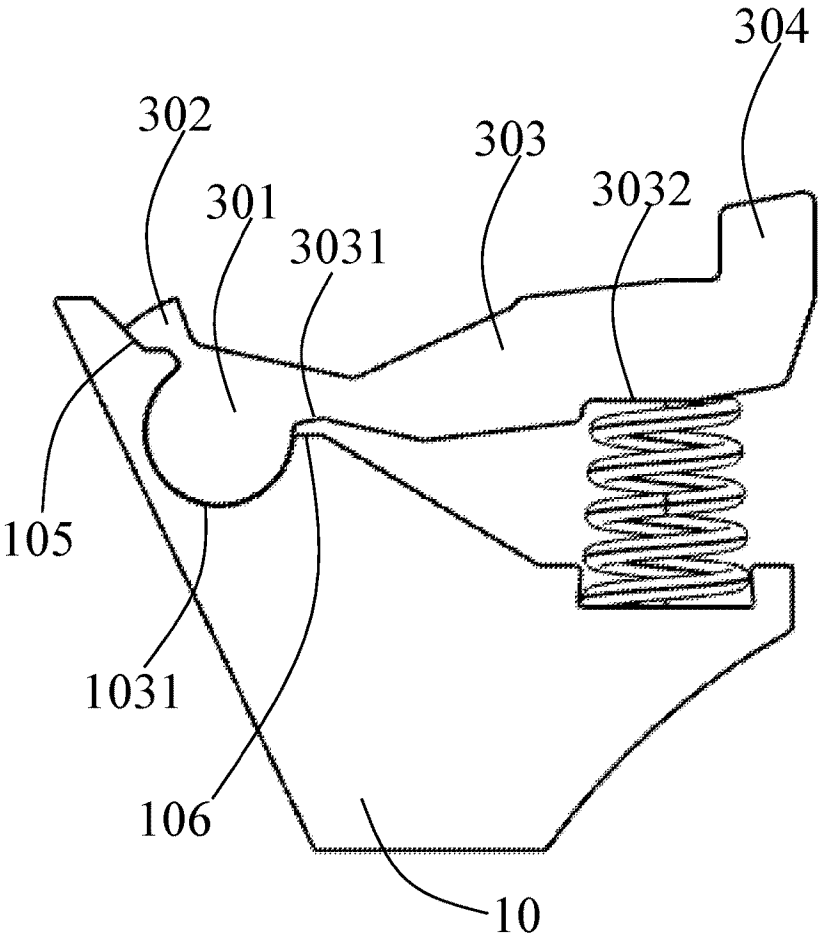
FIG. 7*a* and FIG. 7*b* are side views showing the assemblies of the base, the firing pin releaser and a return spring in different states.
Figure 7B:
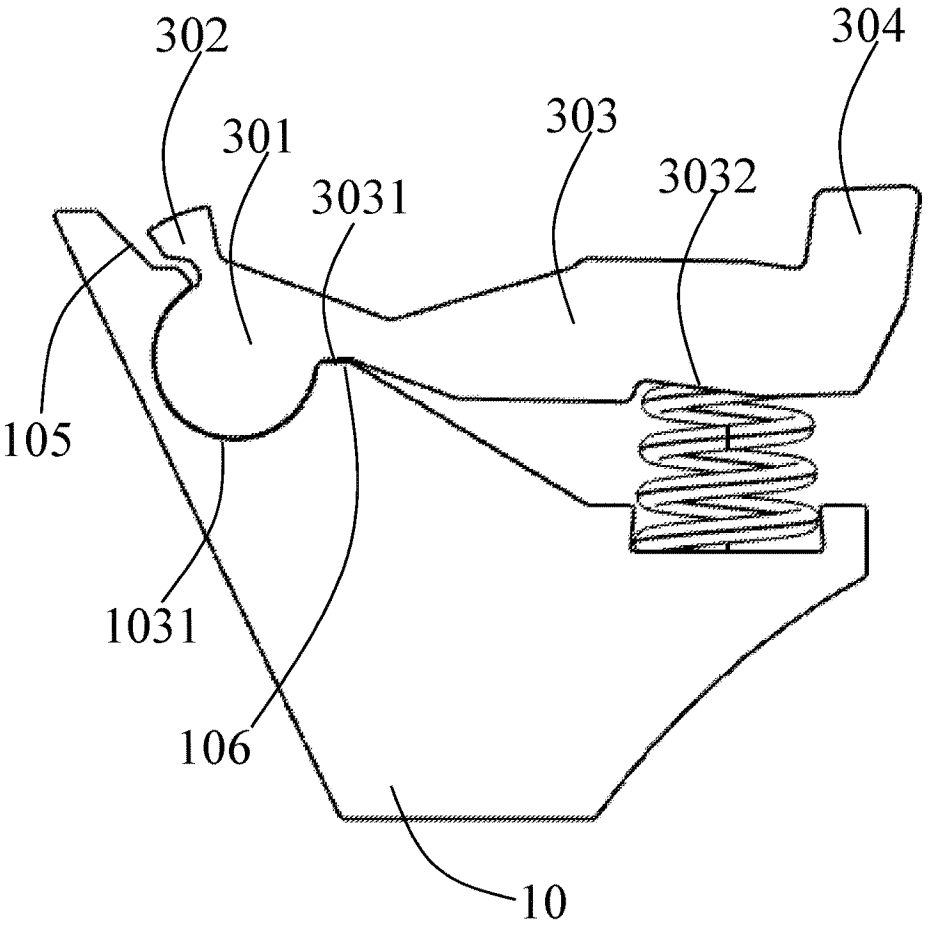

The limit protruding portion 302 is formed on one side of the arc surface turning portion 301. It is designed to ensure that the pistol will not be fired due to vibration, such as falling to the ground, when the pistol is ready to fire. The limit protruding portion 302 stops the arc surface turning portion 301 from rotating toward a forward direction relative to the arc surface groove 1031 by contacting a first side plane 105 of the front end 103. For a better understanding of this, see FIG. 7*a* and FIG. 7*b*. They are side views showing the assemblies of the base 10, the firing pin releaser 30 and the return spring 20 in different states. FIG. 7*a* is the state of the three when the pistol is ready to fire, and FIG. 7*b* is the state of the three when the pistol is in the fired state. It can be seen from FIG. 7*a* and FIG. 7*b* that when the arc surface turning portion 301 is turned relative to the arc surface groove 1031 from the position at right side to that at left side (in this example, it is counterclockwise, corresponding to the forward direction above), the limit protruding portion 302 is blocked by the first side plane 105 and can no longer rotate. Meanwhile, the return spring 20 springs back. The forward direction and a reverse direction to be mentioned later express different rotation directions respectively, without any hidden meaning.

The body portion 303 is extended from and formed on the other side of the arc surface turning portion arc surface turning portion 301. A limit side plane 3031 and a clamping surface 3032 are formed on the bottom of the body portion 303. A guiding plane 3033 is formed on the top of the body portion 303. The return spring 20 is clamped by the clamping surface 3032 and the clamping platform 1041. The body portion 303 stops the arc surface turning portion 301 from rotating toward a reverse direction relative to the arc surface groove 1031 by contacting a second side plane 106 between the front end 103 and the rear end 104 with the limit side plane 3031. See FIG. 7*a* and FIG. 7*b* again. When the arc surface turning portion 301 is turned relative to the arc surface groove 1031 the position at left side to that at right side (in this example, clockwise, corresponding to the reverse direction above), the limit side plane 3031 of the body portion 303 is blocked by the second side plane 106 and cannot continue to rotate clockwise. Meanwhile, the return spring 20 is compressed. The function of the return spring 20 is to provide the power for the body portion 303 to return to the ready-to-fire state when the body portion 303 is in the fired state. According to the present invention, a rotatable angle that the arc surface turning portion 301 is able to rotate relative to the arc surface groove 1031 (from the relative position in FIG. 7*a* to the relative position in FIG. 7*b*, or from the relative position in FIG. 7*b* to the relative position in FIG. 7*a*) ranges from 6 degrees to 10 degrees. In this embodiment, the rotatable angle is 8 degrees.

The release portion 304 is protrudingly formed on the top of an end of the body portion 303. It is for holding or releasing a firing pin handle 5*a* of a firing pin of the pistol 5 (see FIG. 11 and FIG. 12). The operation of release portion 304 will be described in detail below with the relevant figures.

In terms of materials and manufacturing process, like the base 10, the firing pin releaser 30 is also made of metal, such as high-strength carbon steel or alloy steel, formed by electrical discharge machining process. The firing pin releaser 30 has substantially parallel two releaser main plane 305 (the other releaser main plane 305 in FIG. 6 is on the other side of the firing pin releaser 30). The width between the two releaser main planes 305 is slightly smaller than the width of an accommodation space in the trigger mechanism housing 2. In the present embodiment, when the main planes of the base 10 and the main plane of the firing pin releaser 30 fall on a plane on one side, the other main planes of the base 10 and the firing pin releaser 30 fall on another plane on the other side. Therefore, when viewed from the side, when the base 10 is assembled with the firing pin releaser 30, the main planes on both sides are flush.

Figure 2:
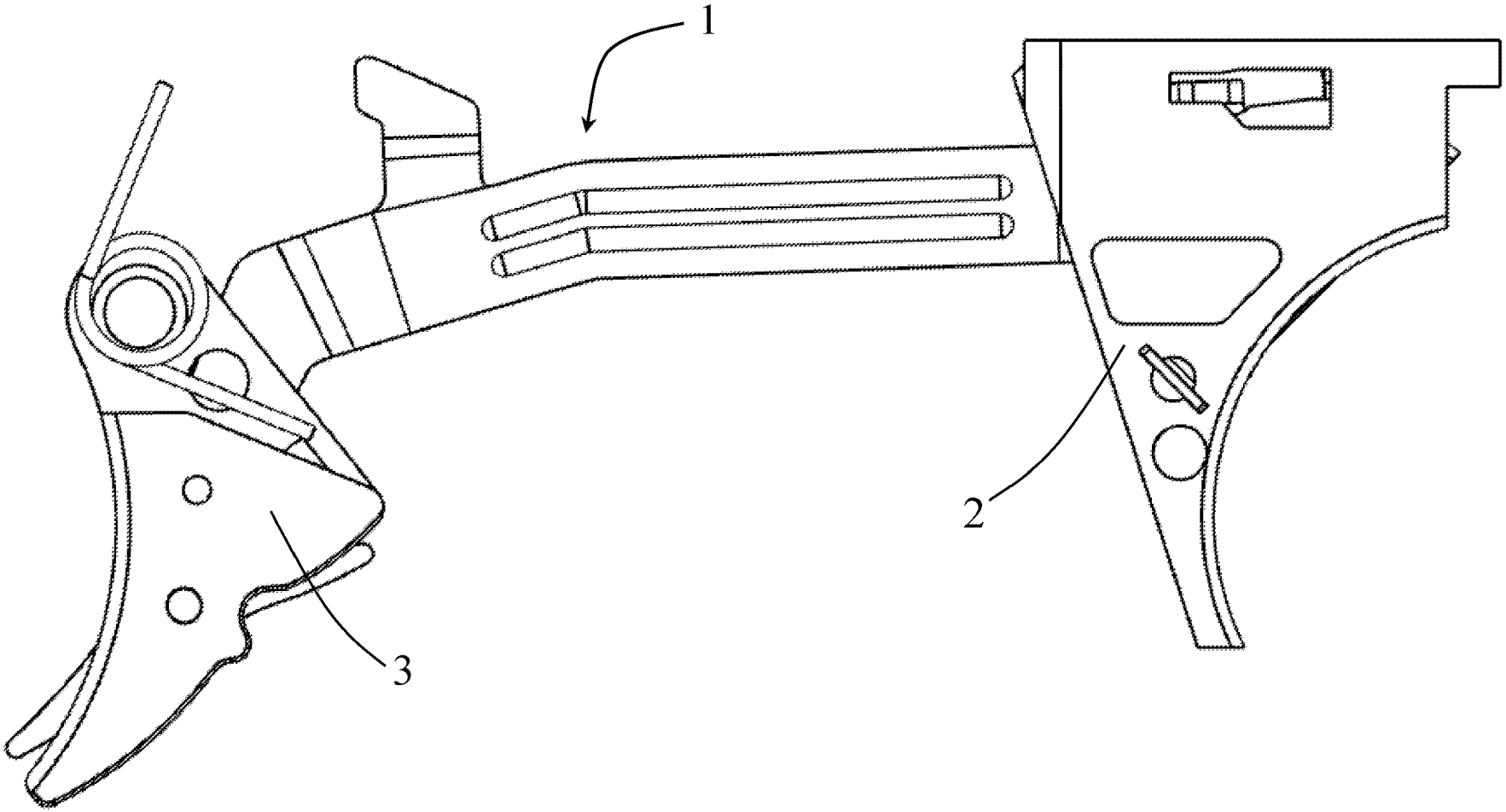
FIG. 2 is a side view of the firing control system with multiple safeties linked to an original trigger and an original trigger mechanism housing of a GLOCK 43.
Figure 8:
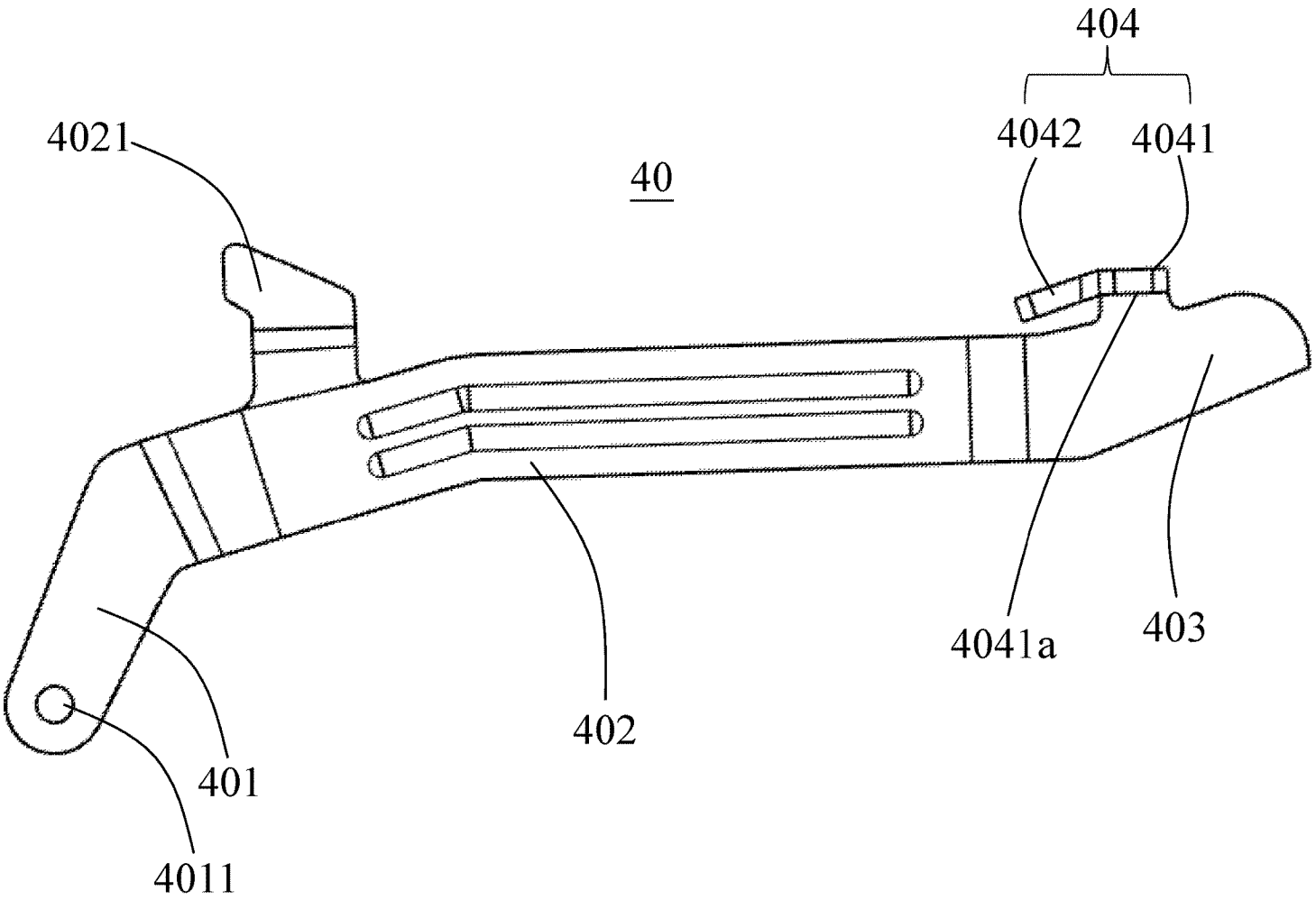
FIG. 8 is a side view of a trigger connecting bar.
Figure 9:
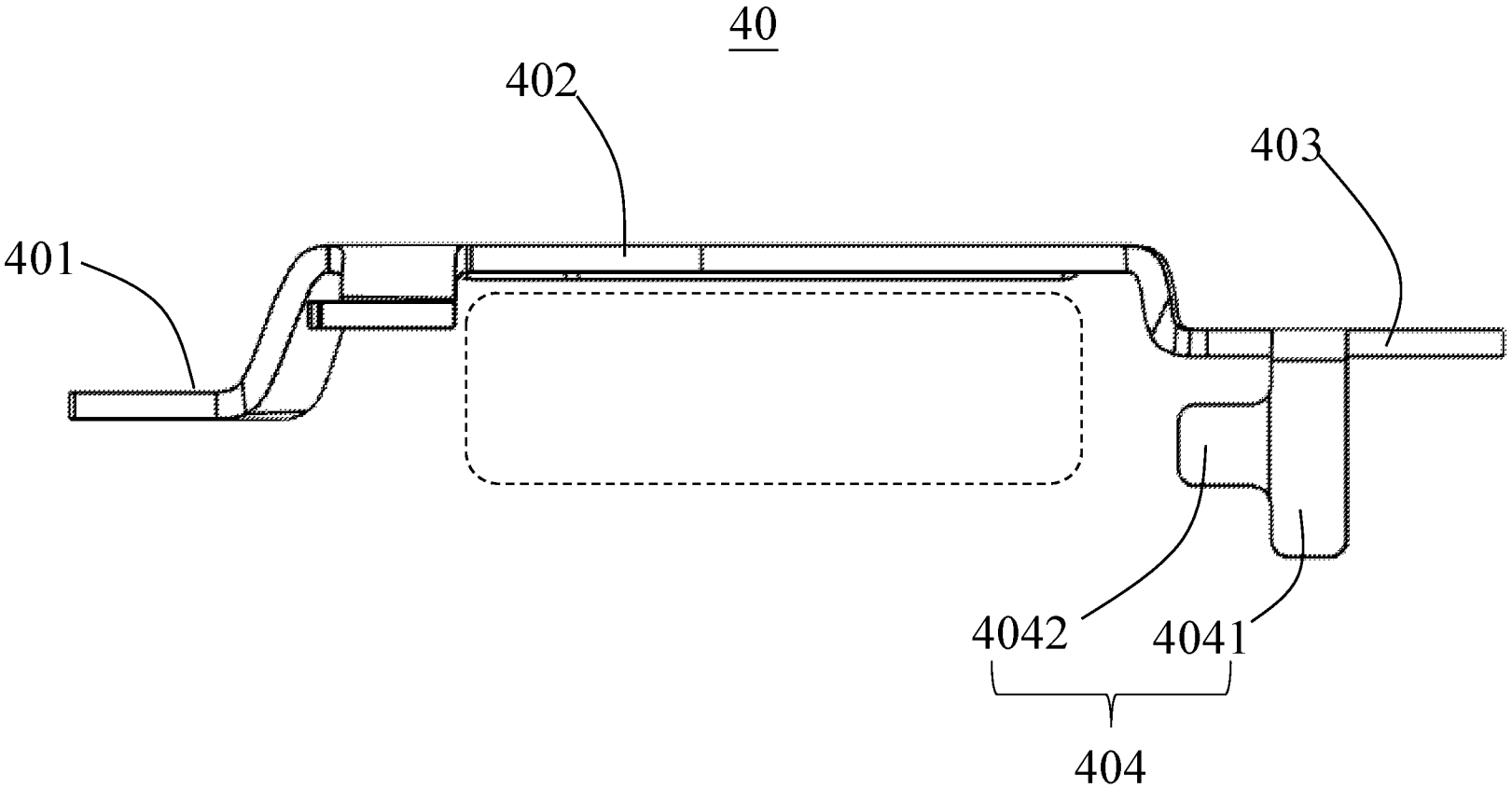
FIG. 9 is a top view of the trigger connecting bar.

See FIG. 2, FIG. 8 and FIG. 9. FIG. 2 is a side view of the firing control system with multiple safeties 1 linked to an original trigger 3 and the original trigger mechanism housing 2 of a GLOCK 43, FIG. 8 is a side view of the trigger connecting bar 40, and FIG. 9 is a top view of the trigger connecting bar 40. trigger connecting bar 40 has a connecting portion 401 movably linking to the trigger 3 of the pistol, a linkage portion 402 bent to bypass a magazine (the position is at the dotted frame in FIG. 9) of the pistol and connected to the connecting portion 401, a guiding portion 403 connected to an end of the linkage portion 402, and a trigger safety portion 404 extended vertically from the guiding portion 403 and movably located above the firing pin releaser 30. As long as the respective tasks can be completed, the types of the connecting portion 401, the linkage portion 402 and the guiding portion 403 are not limited. In the present embodiment, the aforementioned three components can be the same as the original trigger bar design. The difference between trigger connecting bar 40 and the original trigger bar is mainly in the design of the trigger safety portion 404.

Figure 11:
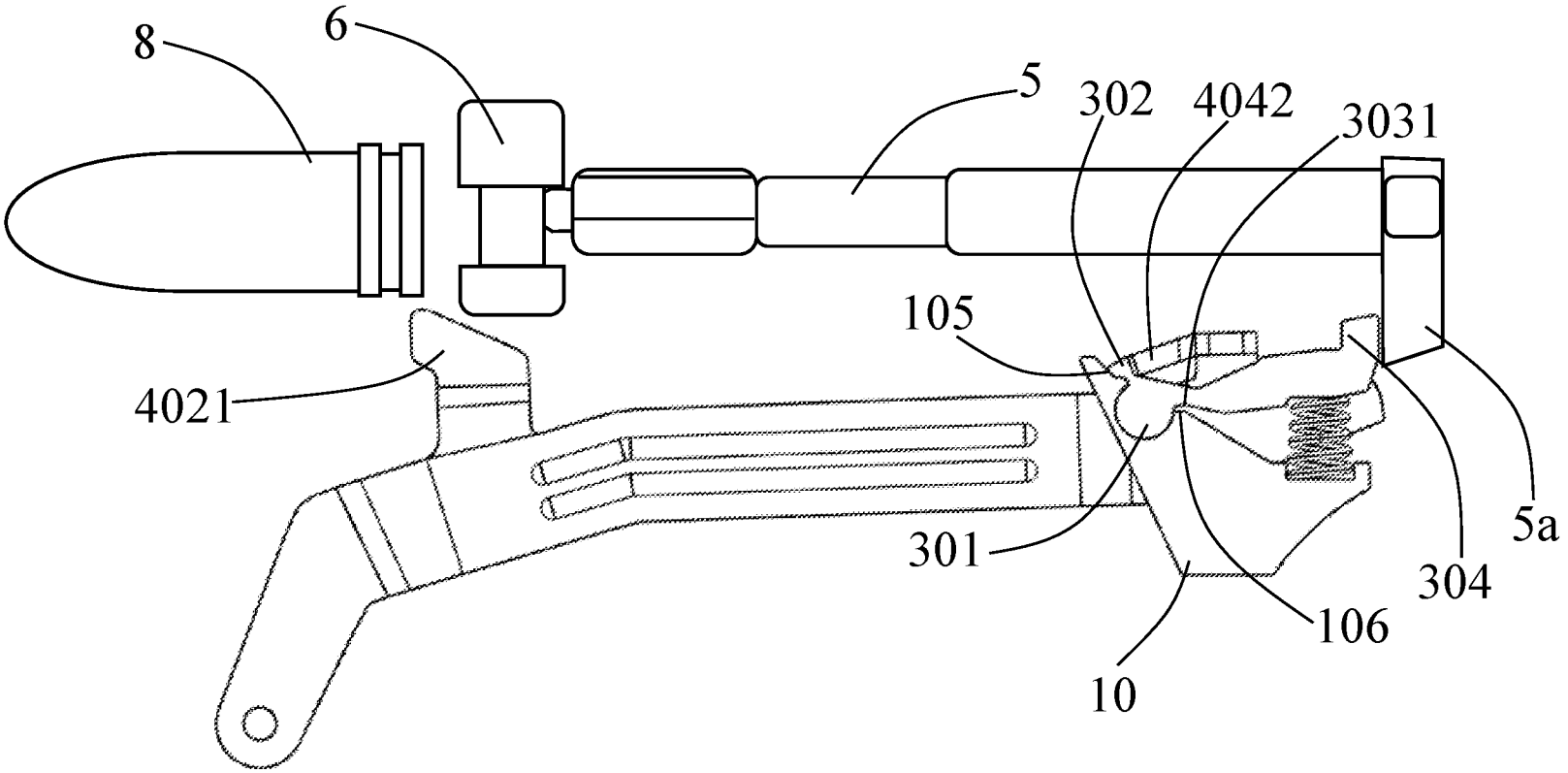
FIG. 11 illustrates the positions of the components of the firing control system with multiple safeties relative to an original firing pin and an original firing pin safety of the GLOCK 43 in the ready-to-fire state.
Figure 12:
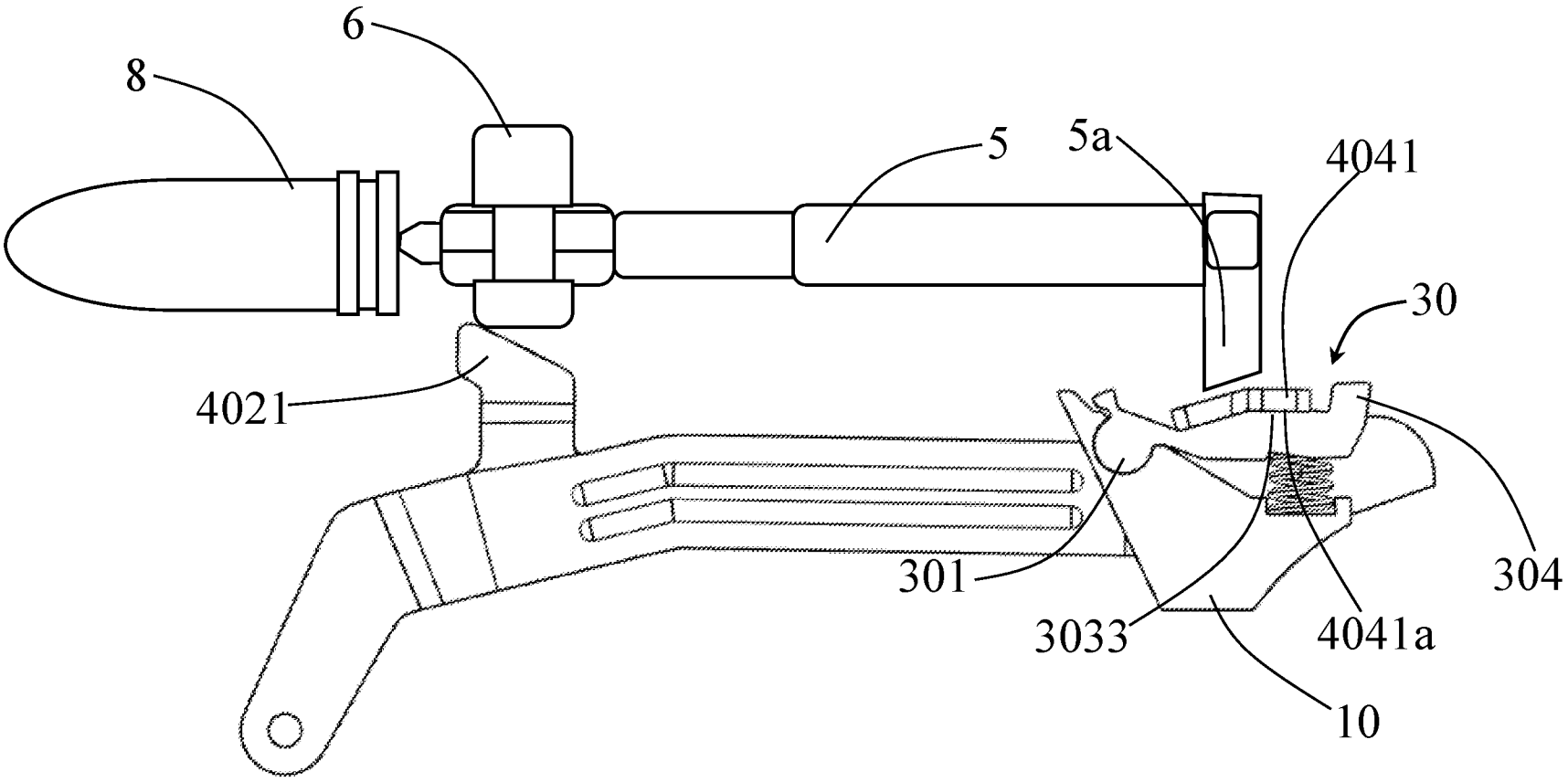
FIG. 12 illustrates the positions of the components of the firing control system with multiple safeties relative to the original firing pin and the original firing pin safety of the GLOCK 43 in the fired state.

A perforation 4011 is formed on the connecting portion 401. The perforation 4011 and the trigger 3 can be connected by a pin. A firing pin safety switch 4021 is formed on and protruded from the top of the linkage portion 402. See FIG. 11 and FIG. 12. FIG. 11 illustrates the positions of the components of the firing control system with multiple safeties 1 relative to an original firing pin 5 and an original firing pin safety 6 of the GLOCK 43 in the ready-to-fire state. FIG. 12 illustrates the positions of the components of the firing control system with multiple safeties 1 relative to the original firing pin 5 and the original firing pin safety 6 of the GLOCK 43 in the fired state. The top of the firing pin safety switch 4021 meets the firing pin safety 6 of the pistol. After the trigger 3 under the status ready to fire is pulled and the trigger connecting bar 40 is linked to move, the firing pin safety switch 4021 moves up slightly to turn on the firing pin safety 6 (from the position of FIG. 11 to the position of FIG. 12) and returns to original position by the elasticity of the firing pin safety switch 4021 after shooting (from the position of FIG. 12 to the position of FIG. 11).

Figure 10A:
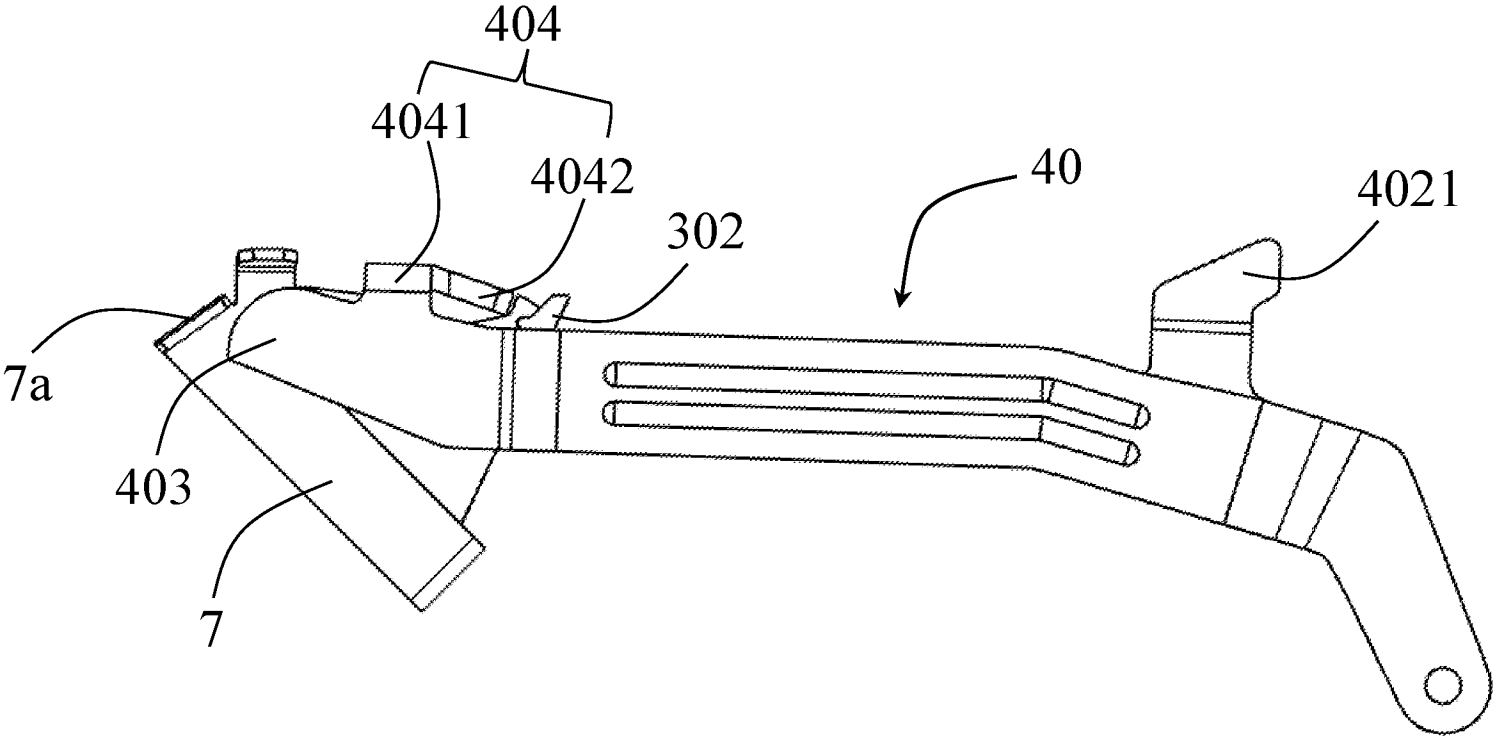
FIG. 10*a* and FIG. 10*b* show position changes of the trigger connecting bar relative to an original connector of the GLOCK 43 in the ready-to-fire state and the fired state.
Figure 10B:
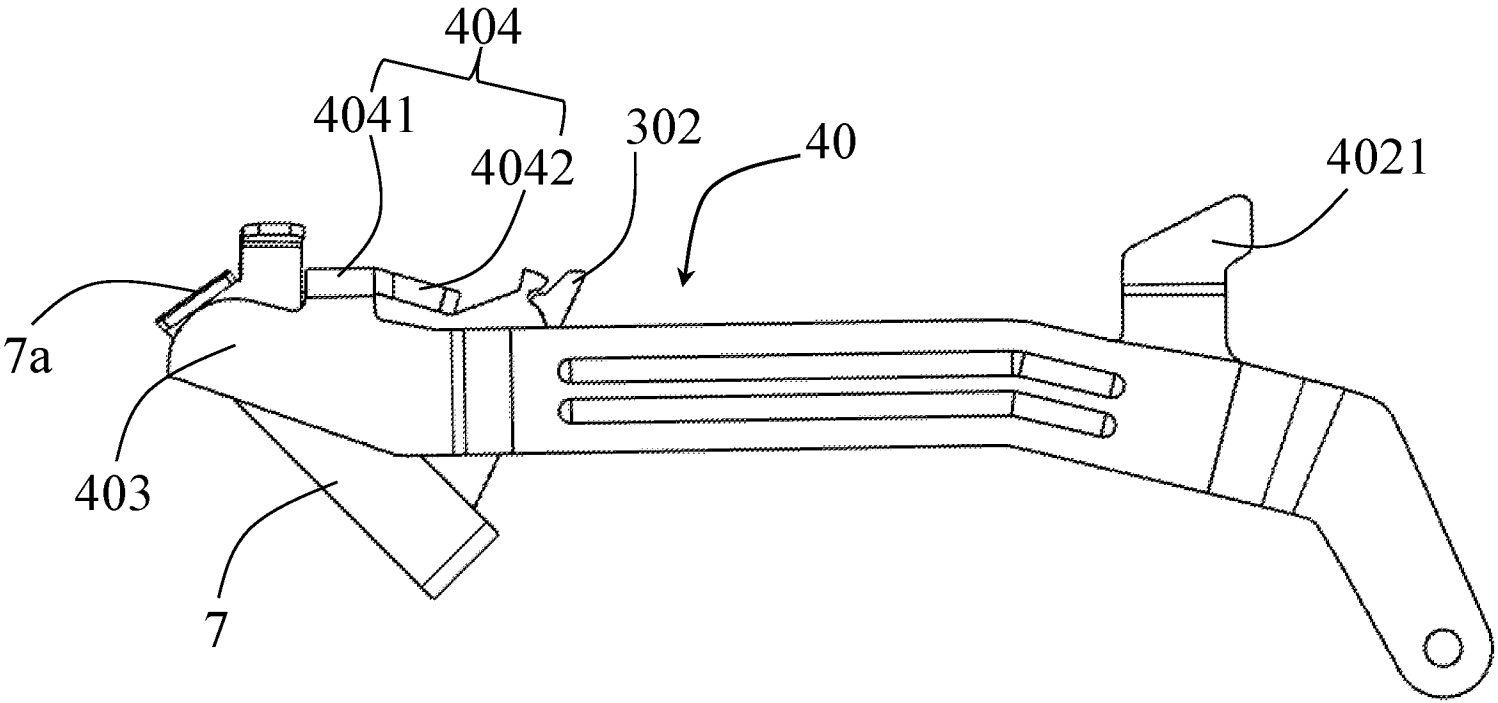

See FIG. 10*a* and FIG. 10*b*. The two figures compare position changes of the trigger connecting bar 40 relative to an original connector 7 of the GLOCK 43 in the ready-to-fire state (upper side) and the fired state (lower side). The connector 7 is installed in the trigger mechanism housing 2 and is used to guide the original trigger bar to move. The body of connector 7 is a flat plate, which contains a sideways guide plate 7*a*. The guiding portion 403 is placed in the connector 7 of the pistol. The guiding portion 403 forms an arc-shaped area facing the sideways guide plate 7*a*. After the trigger 3 under the status ready to fire is pulled and the trigger connecting bar 40 is linked to move, the arc-shaped area touches the sideways guide plate 7*a*, as shown in FIG. 10*a*. Since the backward force of trigger connecting bar 40 does not stop, the arc-shaped area is pushed by the reaction force of the sideways guide plate 7*a* to move toward the direction below the pistol, as shown in FIG. 10*b*.

The trigger safety portion 404 includes an extension board 4041 and a stopping moving board 4042. The extension board 4041 is extended vertically from the guiding portion 403 and has a suppressing plane 4041*a* formed below. The stopping moving board 4042 faces the limit protruding portion 302 and is formed in the middle of the extension board 4041. An angle is formed between the stopping moving board 4042 and the extension board 4041. In the present embodiment, the angle is about 20 degrees. From FIG. 9, the top of the trigger safety portion 404 looks like a "T" shape.

Overall, the trigger connecting bar 40 may be made from a metal plate and shaped by stamping process. The metal plate may be made of high-strength carbon steel or alloy steel.

See FIG. 11 again. When the firing pin 5 is ready to fire, the trigger safety portion 404 (end of the stopping moving board 4042) suppresses the limit protruding portion 302 upon the first side plane 105, so that the release portion 304 is moved up by rotation of the arc surface turning portion 301 to hold the firing pin handle 5*a*. At this moment, since the limit protrusion 302 is blocked by the stop plate 4042 and cannot move, the release portion 304 also tightly hold the firing pin handle 5*a*. A safe protection mechanism is formed. Unless the trigger 3 is pulled, the position of the trigger connecting bar 40 shifts, and the trigger safety portion 404 moves backward and downward, causing the stopping moving board 4042 to loosen from the limit protruding portion 302 to loosen, the firing pin handle 5*a* won't escape from the release portion 304, causing the firing pin 5 hit the bullet 8 by its own spring force to lead to a misfire. See FIG. 12. After the trigger 3 under a status ready to fire is pulled, the trigger connecting bar 40 is linked to move, the suppressing plane 4041*a* of the extension board 4041 slides along the guiding plane 3033 and the body portion 303 is pushed down to rotate the firing pin releaser 30 relative to the base 10. The firing pin handle 5*a* is released to let the firing pin 5 fires the bullet 8 according to the normal firing procedure. In detail, please refer to FIG. 10*a*, FIG. 10*b* and FIG. 11 synchronously. The guiding portion 403 is pushed by the connector 7 to move down toward a direction below the pistol, driving the trigger safety portion 404 to move toward the direction below the pistol and the direction of the release portion 403, so that the firing pin releaser 30 rotates relative to the base 10 by the arc surface turning portion 301 rotating relative to the arc surface groove 1031 until the limit side plane 3031 contacts the second side plane 106, and the position of the release portion 304 is lowered to release the firing pin handle 5*a*. After the pistol fires, the firing pin handle 5*a* sits above the trigger safety portion 404.

The original trigger bar of GLOCK 43 not only has the function of guiding for firing, but also has the function of pulling the firing pin 5 to move backward to position for firing. However, the firing control system with multiple safety 1 of the present invention does not have this function after replacing the original trigger bar. Instead, the movement of a slide of the pistol is used to drive the firing pin 5. In particular, when a slide of the pistol moves backwards, the firing pin 5 is driven to move, causing the firing pin handle 5*a* to move toward the rear of the release portion 304 after pushing down the release portion 304, from the position in FIG. 12 back to the position in FIG. 11. The release portion 304 is pushed to move down to let the firing pin releaser 30 rotate relative to the base 10 by the arc surface turning portion 301 rotating relative to the arc surface groove 1031, and the firing pin releaser 30 is rotated back to original position by the return spring 20, so that the release portion 304 holds the firing pin handle 5*a* again.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims, which are to be accorded with the broadest interpretation so as to encompass all such modifications and similar structures.

What is claimed is:

1. A firing control system with multiple safeties for replacing a trigger bar and a trigger spring in a striker-fired semi-automatic handgun, comprising:

a base, installed inside a trigger mechanism housing of the pistol, having a front end and a rear end which is lower than the front end, wherein an arc surface groove is formed in the front end, and the rear end is concave to form a clamping platform;

a return spring, an end thereof is placed on the clamping platform;

a firing pin releaser, comprising:

an arc surface turning portion, rotatably mounted in the arc surface groove;

a limit protruding portion, formed on one side of the arc surface turning portion, stopping the arc surface turning portion from rotating toward a forward direction relative to the arc surface groove by contacting a first side plane of the front end;

a body portion, extended from and formed on the other side of the arc surface turning portion, wherein a limit side plane and a clamping surface are formed on the bottom of the body portion, the body portion stops the arc surface turning portion from rotating toward a reverse direction relative to the arc surface groove by contacting a second side plane between the front end and the rear end with the limit side plane, and the return spring is clamped by the clamping surface and the clamping platform clamp; and a release portion, protrudingly formed on the top of an end of the body portion, for holding or releasing firing pin handle of a firing pin of the pistol; and a trigger connecting bar, having a connecting portion movably linking to a trigger of the pistol, a linkage portion bent to bypass a magazine of the pistol and connected to the connecting portion, a guiding portion connected to an end of the linkage portion, and a trigger safety portion extended vertically from the guiding portion and movably located above the firing pin releaser, wherein the guiding portion is placed in a connector of the pistol, and when the firing pin of the pistol is ready to fire, the trigger safety portion suppresses the limit protruding portion upon the first side plane, so that the release portion is moved up by rotation of the arc surface turning portion to hold the firing pin handle.

2. The firing control system with multiple safeties according to claim 1, wherein after the trigger under a status ready to fire is pulled, the trigger connecting bar is linked to move, the guiding portion is pushed by the connector to move down toward a direction below the pistol, driving the trigger safety portion to move toward the direction below the pistol and the direction of the release portion, so that the firing pin releaser rotates relative to the base by the arc surface turning portion rotating relative to the arc surface groove until the limit side plane contacts the second side plane, and the position of the release portion is lowered to release the firing pin handle.

3. The firing control system with multiple safeties according to claim 2, wherein a guiding plane is formed on the top of the body portion.

4. The firing control system with multiple safeties according to claim 3, wherein the trigger safety portion further comprises:

an extension board, extended vertically from the guiding portion, having a suppressing plane formed below; and a stopping moving board, facing the limit protruding portion and being formed in the middle of the extension board, wherein an angle is formed between the stopping moving board and the extension board, wherein, when the firing pin is ready to fire, the end of the stopping moving board suppresses the limit protruding portion upon the first side plane, and after the trigger under the status ready to fire is pulled, the suppressing plane of the extension board slides along the guiding plane and the body portion is pushed down to rotate the firing pin releaser relative to the base.

5. The firing control system with multiple safeties according to claim 2, wherein the connector comprises a sideways guide plate, the guiding portion forms an arc-shaped area facing the sideways guide plate, and after the trigger under the status ready to fire is pulled and the trigger connecting bar is linked to move, the arc-shaped area touches the sideways guide plate and is pushed by the sideways guide plate to move toward the direction below the pistol.

6. The firing control system with multiple safeties according to claim 1, wherein the a firing pin safety switch is further formed on and protruded from the top of the linkage portion, the top of the firing pin safety switch meets a firing pin safety of the pistol, after the trigger under the status ready to fire is pulled and the trigger connecting bar is linked to move, the firing pin safety switch moves up slightly to turn on the firing pin safety and returns to original position by the elasticity of the firing pin safety switch after shooting.

7. The firing control system with multiple safeties according to claim 1, wherein a rotatable angle that the arc surface turning portion is able to rotate relative to the arc surface groove ranges from 6 degrees to 10 degrees.

8. The firing control system with multiple safeties according to claim 1, wherein the base and the firing pin releaser have substantially parallel two main planes, respectively, and when the main planes of the base and the main plane of the firing pin releaser fall on a plane on one side, the other main planes of the base and the firing pin releaser fall on another plane on the other side.

9. The firing control system with multiple safeties according to claim 1, wherein after the pistol fires, the firing pin handle sits above the trigger safety portion.

10. The firing control system with multiple safeties according to claim 9, wherein when a slide of the pistol moves backwards, the firing pin is driven to move, causing the firing pin handle to move toward the rear of the release portion after pushing down the release portion, the release portion is pushed to move down to let the firing pin releaser rotate relative to the base by the arc surface turning portion rotating relative to the arc surface groove, and the firing pin releaser is rotated back to original position by the return spring, so that the release portion holds the firing pin handle again.

11. The firing control system with multiple safeties according to claim 1, wherein the base and the firing pin releaser is made of metal and formed by electrical discharge machining process.

12. The firing control system with multiple safeties according to claim 1, wherein the trigger connecting bar is made from metal plate and shaped by stamping process.

* * * * *